US005367936A

United States Patent [19]

Held et al.

[11] Patent Number: 5,367,936

[45] Date of Patent: Nov. 29, 1994

[54] ADJUSTABLE CUTTING KNIFE CYLINDER

[75] Inventors: Michael Held, Heuchelheim; Holger Ratz, Frankenthal, both of Germany

[73] Assignee: Albert-Frankenthal Aktiengesellschaft, Wurzburg, Germany

[21] Appl. No.: 26,693

[22] Filed: Mar. 5, 1993

[30] Foreign Application Priority Data

Mar. 6, 1992 [DE] Germany ..... 4207209

[51] Int. Cl.[5] ..... B26D 1/62

[52] U.S. Cl. ..... 83/698.61; 83/674; 83/698.51

[58] Field of Search ..... 83/698, 699, 700, 674

[56] References Cited

U.S. PATENT DOCUMENTS

| | | | |
|---|---|---|---|
| 1,986,212 | 1/1935 | Mahon . | |
| 2,832,411 | 4/1958 | Richards et al. . | |
| 3,340,757 | 9/1967 | Rudszinat | 83/674 B X |
| 3,477,328 | 11/1969 | Schonmeier et al. | 83/700 X |
| 3,709,077 | 1/1973 | Trogan et al. | 83/699 X |
| 3,935,774 | 2/1976 | Craddy | 83/699 X |
| 4,009,626 | 3/1977 | Gressman | 83/116 |
| 4,147,337 | 4/1979 | Bolza-Schunemann . | |
| 4,475,425 | 10/1984 | Punater et al. | 83/700 |
| 4,485,710 | 12/1984 | Schlisio et al. | 83/700 X |
| 4,860,623 | 8/1989 | Pawelko | 83/699 X |
| 5,211,096 | 5/1993 | Steidinger | 83/674 |

FOREIGN PATENT DOCUMENTS

| | | |
|---|---|---|
| 0364864 | 10/1989 | European Pat. Off. . |
| 0418088 | 9/1990 | European Pat. Off. . |
| 2656267 | 12/1976 | Germany . |
| 396486 | 3/1931 | United Kingdom . |

*Primary Examiner*—Eugenia Jones

*Attorney, Agent, or Firm*—Jones, Tullar & Cooper

[57] ABSTRACT

An adjustable cutting knife cylinder in a folder has one or more cutting blades or knives supported at the periphery of a cylinder body. Each blade or knife is adjustable both in a radial and in a circumferential direction. Separate adjusting assemblies are utilized to effect the radial and circumferential movements of the blade or blades.

5 Claims, 5 Drawing Sheets

ADJUSTABLE CUTTING KNIFE CYLINDER

FIELD OF THE INVENTION

The present invention is directed generally to an adjustable cutting knife cylinder. More particularly, the present invention is directed to an adjustable cutting knife cylinder for a folder. Most specifically, the present invention is directed to an adjustable cutting knife cylinder in which the cutting or perforating knife carried by the cylinder is adjustable both radially and circumferentially with respect to the cutting or perforating cylinder. The cutting or perforating blade is supported on the periphery of the cylinder in the folder and can be moved radially with respect to the cylinder to vary the extension of the blade beyond the outer peripheral surface of the cutting or perforating cylinder. The blade is also shiftable circumferentially on the surface of the cylinder in a direction generally at 90° to the direction of radial movement of the blade.

DESCRIPTION OF THE PRIOR ART

Cutting and perforating blades are generally known in the art. These blades are typically supported on rotatable cutting blade cylinders and are used in conjunction with cooperating counter cutting cylinders to either cut or to perforate sheets of paper or assembled groups of sheets, or signatures. These cutting or perforating blade cylinders are frequently utilized in folders where a printed web or sheet or sheets are cut and folded to form an assembled signature which is then subsequently further processed.

In one prior art device which is shown in German document DE 26 56 267 A1 there is shown a cutting blade cylinder in which the cutting knife can be moved radially with respect to its supporting cylinder so that it can cut several plies of sheets. The radial shifting of the blade in this prior art device is accomplished by providing wedge-shaped means which are shiftable in the longitudinal axis of the cutting blade cylinder. The radial shifting of the cutting knife is always effected together with a coordinated shifting of the counter cutting cylinder. This is done to ensure that there will be provided an optimal distance between the cutting knife and the counter cutting bar in accordance with the changing thickness of the sheet pile to be cut. This optimal spacing is also necessary to insure good operating conditions during the transport of the sheet plies through the folder.

In this prior art cutting blade cylinder assembly, there is no discussion or suggestion that the cutting blades could be shifted radially a sufficient distance to move one or more of the blades completely out of operation. Thus while radial adjustment or shifting of the blades is discussed, movement of the blades in a radial manner so that one or more of the blades can be totally put out of operation is not discussed in this prior art document.

Folding assemblies must be adaptable to various kinds of production. If possible, a folder should be adjustable to the largest possible number of kinds of production. In the prior art, this has been accomplished by providing folders in which the cylinder groups are adjustable to accomplish exclusively cutting, first cross folding, first plus second cross folding, or delta folding. To accomplish this purpose of multiple capability, the cutting cylinder and the counter cutting bar cylinder which cooperate with the cutting cylinder must have several knives or counter cutting bars which are placed in an irregular manner about their periphery or peripheries. In this way, for example, the cutting cylinder may have three knives and one counter cutting bar and the counter cutting bar cylinder may have one knife and three counter cutting bars.

In the prior art devices, it was not possible to radially adjust the knives to a point where a particular knife was moved to an inoperative position. This movement was done by removing a knife and by inserting a filling element in its spot. Such a process of removal of a knife and substitution of a filling element can only be done during a period when the machine is at a standstill with a consequential loss of production. Additionally, these filling pieces must be properly and carefully installed since an improperly secured piece could come loose during rotation of the cutting blade cylinder and could clearly pose a danger for the operating personnel.

It will be apparent that a need exists for a cutting blade cylinder that overcomes the limitations of the prior art. The adjustable cutting knife cylinder of the present invention provides such a device and is a significant improvement over the prior art devices.

SUMMARY OF THE INVENTION

It is an object of the present invention to provide an adjustable cutting knife cylinder.

Another object of the present invention is to provide an adjustable cutting knife cylinder in a folder.

A further object of the present invention is to provide an adjustable cutting knife cylinder in which the cutting or perforating knife or blade is adjustable both radially and circumferentially.

Still another object of the present invention is to provide an adjustable cutting knife cylinder in which the cutting or perforating blade or knife is adjustable radially to a non-use position.

Yet a further object of the present invention is to provide an adjustable cutting knife cylinder in which the knife is adjustable radially and circumferentially without stoppage of the cylinder.

As will be discussed in greater detail in the description of the preferred embodiment which is presented subsequently, the present invention provides a device for holding a cutting or perforating knife or blade on a cylinder of a folder in which it is possible to infinitely adjust or vary the cutting or perforating intensity and/or to accurately adjust the cutting part of a cutting knife or the perforating side on the fold. Each knife blade is supported in a groove in the cutting blade cylinder so that it can be moved both radially and circumferentially on the periphery of the cylinder. Axially slidable wedging elements effect the radial and/or circumferential shifting of the cutting or perforating blades. Suitable devices can be provided, together with the appropriate controls so that the position of the blade or blades can be effected from a remote location during operation of the printing machine. This adjustability allows both the intensity and the line of influence of the cutting or perforating force to be adjusted very accurately and exactly. Various motors and other remotely adjustable assemblies can be utilized to provide for the radial and/or circumferential adjustment of the position of the blades during operation of the folder.

Each individual cutting or perforating knife can be quickly and easily retracted beneath the periphery of the cutting blade cylinder of the present invention. This means that the cylinders can be used for several different kinds of production by the specific positioning of several blades around the periphery of the cylinder. Knives that are not needed during a particular operation can be quickly taken out of use without the need for stopping production for the insertion of filling pieces.

Another advantage of the present invention is in its ability to shift the position of one or more knives in the circumferential direction. This allows the cutting blade cylinder, which is cooperating with a collecting cylinder, to cut sheet plies alternatively "short" or "long". This allows there to be provided thicker collected products with sheet plies which are positioned atop each other and which are optically perfect such that an inner sheet does not project over an outer sheet ply.

It will thus be seen that the adjustable cutting knife cylinder of the present invention overcomes the limitations of the prior art device. It provides an apparatus which is a substantial advance in the art.

BRIEF DESCRIPTION OF THE DRAWINGS

While the novel features of the adjustable cutting knife cylinder in accordance with the present invention are set forth with particularity in the appended claims, a full and complete understanding of the invention may be had by referring to the detailed description of the preferred embodiment, as set forth subsequently, and as illustrated in the accompanying drawings, in which:

DESCRIPTION OF THE PREFERRED EMBODIMENT

Figure 1:
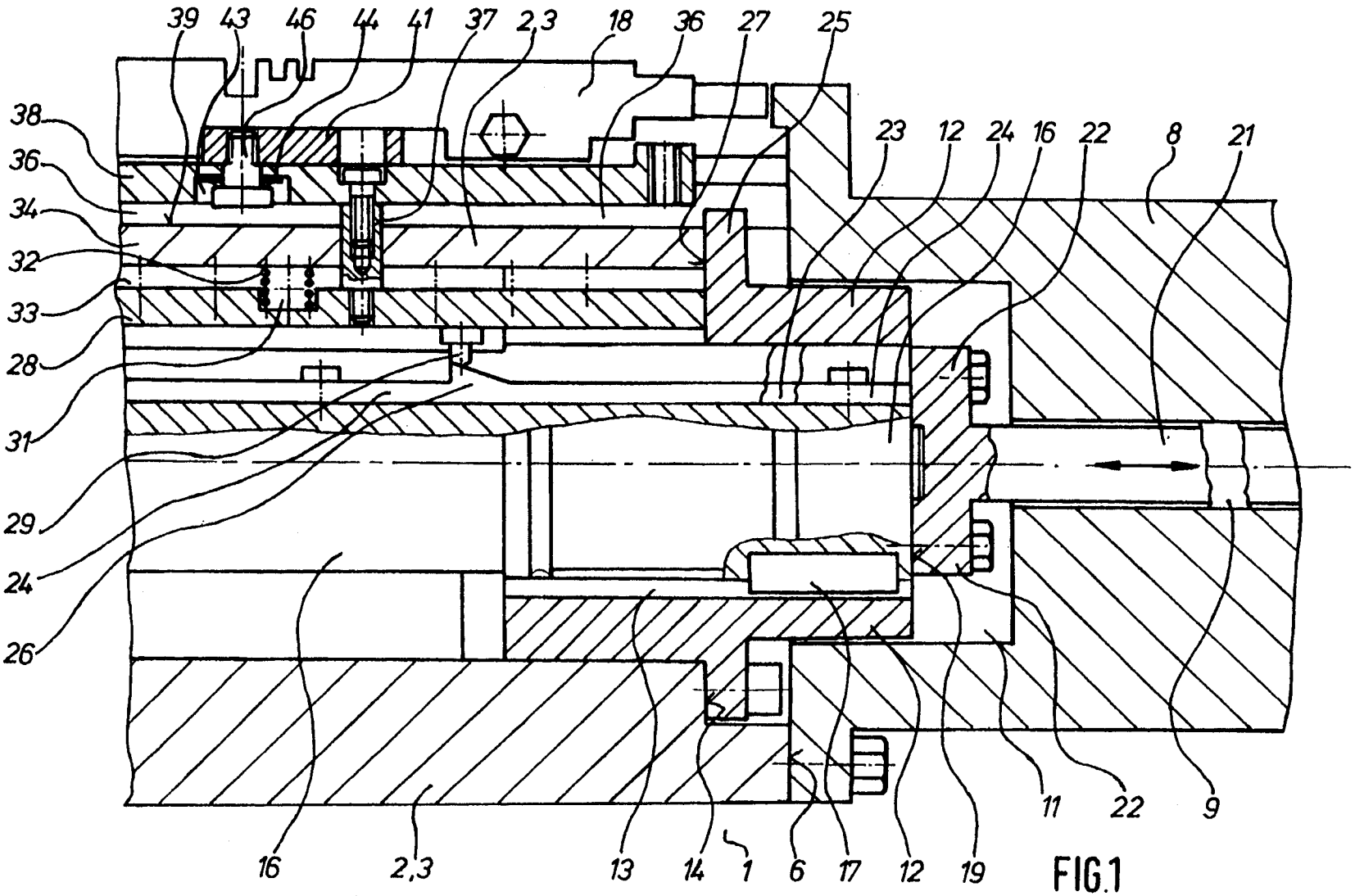
FIG. 1 is a side elevation view, partly in section of a right end of an adjustable cutting knife cylinder in accordance with the present invention and showing the assembly for accomplishing a radial adjustment of the knife.
Figure 2:
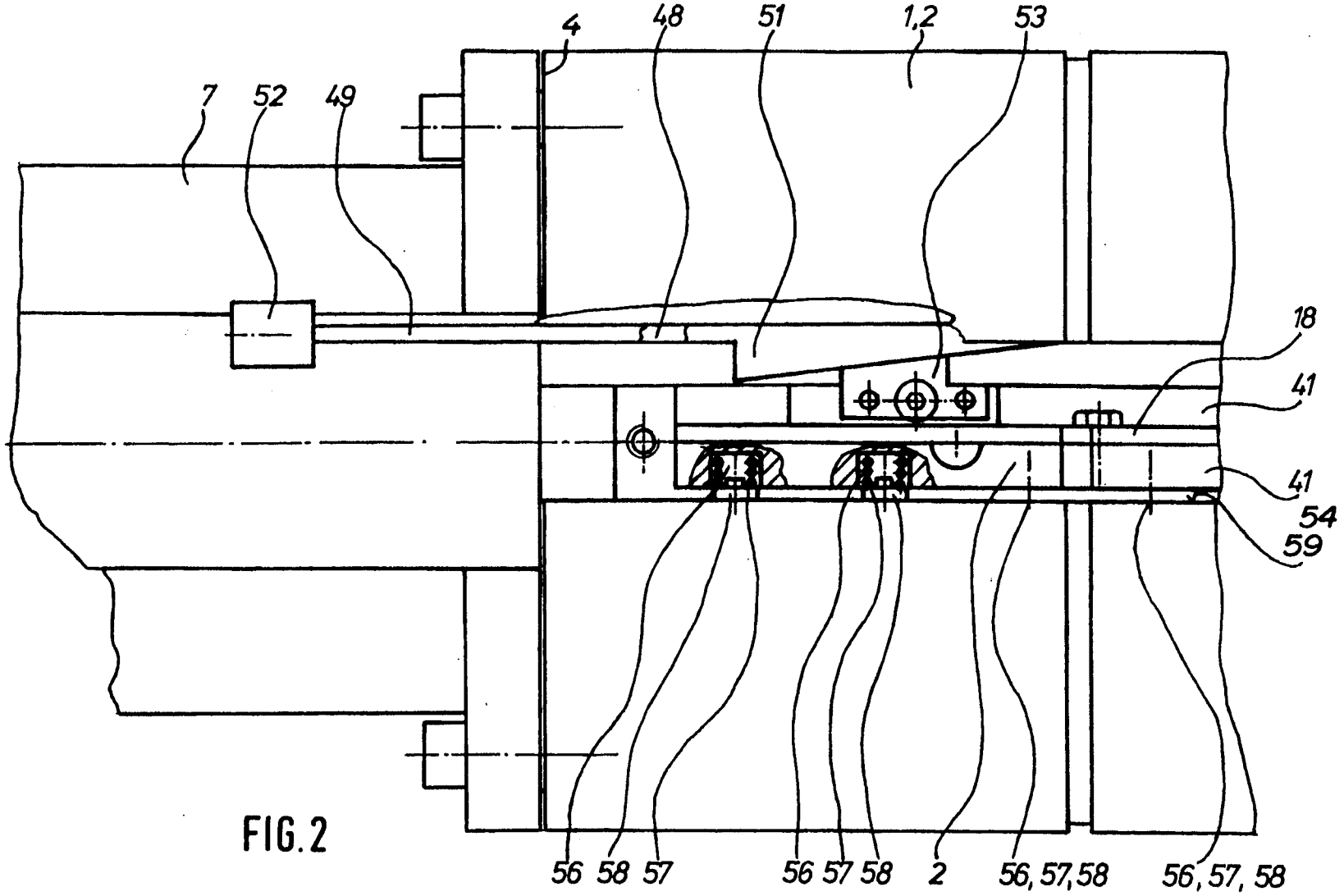
FIG. 2 is a top plan view of a left end of an adjustable cutting knife cylinder and showing the assembly for the circumferential adjustment of the knife.

Referring initially to FIG. 1, there may be seen generally at 1 an adjustable cutting knife cylinder in accordance with the present invention. It will be understood that FIG. 1 is a side elevation depiction of only a portion of an entire cutting knife cylinder and shows only the right end of the cylinder. FIG. 2 shows a top plan view of a left end portion of the cylinder. The overall length of the cylinder will vary with the type of printing press in which it is used. It will also be understood that this adjustable cutting knife cylinder 1 is intended for use with a counter cutting bar cylinder in a folding unit of a sheet or web-fed printing press. For convenience of illustration, only the adjustable cutting knife cylinder in accordance with the present invention will be discussed hereafter.

Adjustable cutting knife cylinder 1 utilizes as a base body 2 a thick walled sleeve or cylinder generally at 3. At each end face 4 and 6 of sleeve 3 there is secured a bearing journal 7 or 8 by means of a suitable flange coupling. End face 6 of sleeve 3 and its associated bearing journal 8 are shown in FIG. 1 while end face 4 and bearing journal 7 are shown in FIG. 2. Each bearing journal 7 or 8 has a concentric central bore 9 which terminates in an enlarged recess 11 generally adjacent the flanged end of the bearing journal 8. A generally annular bushing 12 is bolted or otherwise secured to the end face 6 of the sleeve 3 with a free end of bushing 12 extending into the recess 11 in the bearing journal 8. The bushing 12 has a circumferential flange 25 that seats in a stepped down portion 14 on the end face 6 of sleeve 3. A keyway or guide slot 13 is formed on bushing 12 and extends axially along an inner surface of bushing 12 generally parallel to an axis of rotation of the cylinder 1. A similar bushing is secured to the left end face 4 of the sleeve 3.

An axially adjustable spindle 16 is, as may be seen most clearly in FIG. 1, supported in the hollow sleeve 3 for axial movement with respect thereto. Spindle 16 carries keys 17 at its ends with these keys 17 being positioned in the axially extending key slots 13 in the bushings 12. This axially slidable spindle 16 is usable, as will be discussed in detail shortly, to generate a radial movement of one or more cutting or perforating blades or knives, generally at 18 which are carried on the periphery of the sleeve 3 of the adjustable cutting knife cylinder 1.

A push-rod 21 is secured at a first end by means of a flange 22 to a right end face 19 of the axially slidable adjusting spindle 16. This push rod 21 extends through the bore 9 in the bearing journal 8. A second end of push rod 21, which is not specifically shown in FIG. 1, is coupled to a suitable rotatable and axially shiftable adjustment shaft by, for example, the use of a radial thrust bearing. This adjustment shaft can be coupled to a helical gear or the like which is, in turn, electrically or pneumatically driven by an adjusting motor which is reversible and remotely controlled. Thus the push rod 21 can be remotely controlled to shift the adjustable spindle 16 axially along the center line of the cutting knife cylinder. While the adjusting spindle 16 rotates with the cylinder 1, it does not rotate with respect to the cylinder 1 but instead is slidable axially in it.

Figure 3:
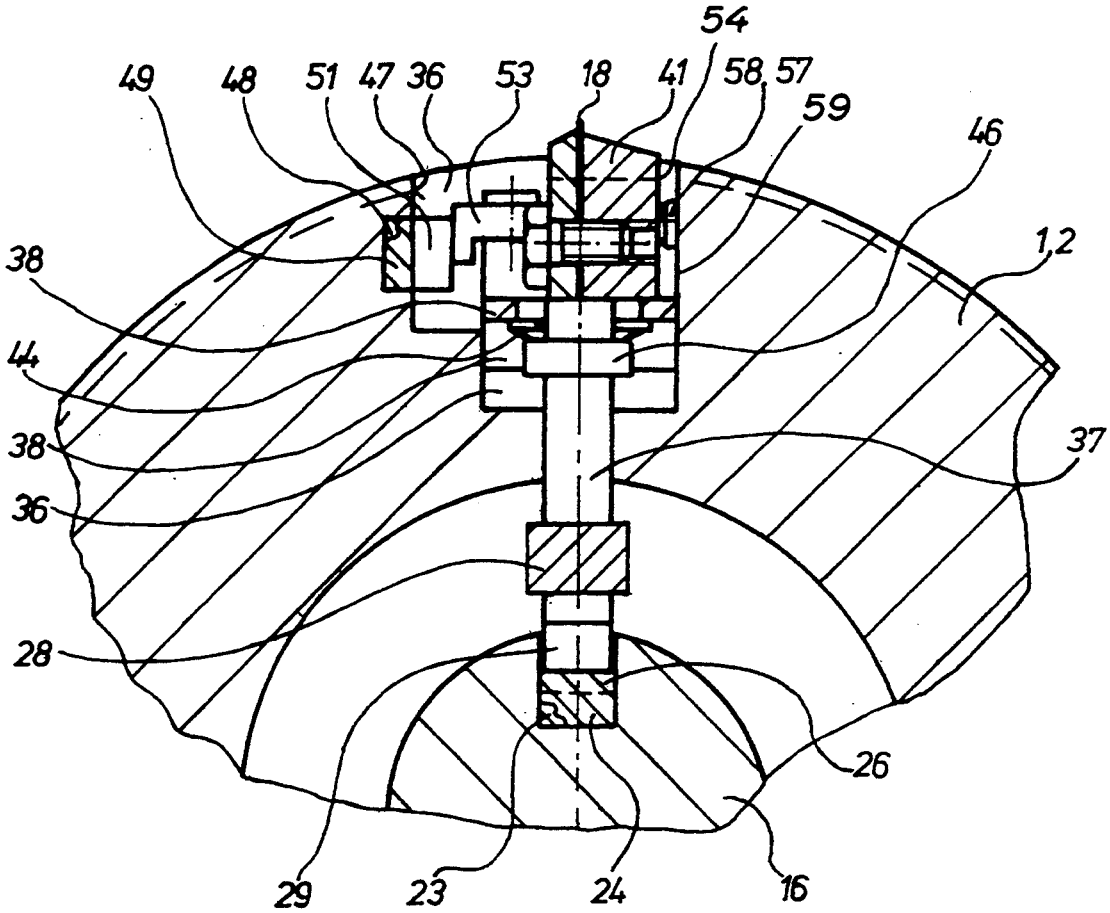
FIG. 3 is an end cross-sectional view of a portion of the adjustable cutting knife cylinder of the present invention.
Figure 4:
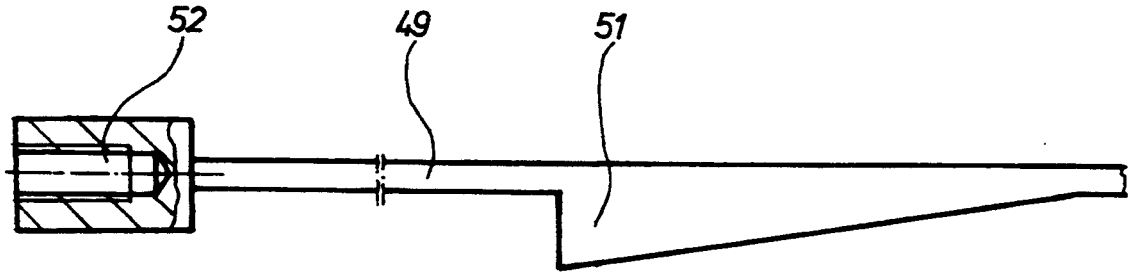
FIG. 4 is a top plan view of a wedge rod for accomplishing circumferential blade adjustment.

A wedge rod 24 is secured to the circumference of the adjusting spindle 16 and extends parallel to the axis of rotation of cylinder 1. While only one such wedge rod 24 is depicted in FIGS. 2 and 3, it will be understood that the number of wedge rods 24 on the adjusting spindle 16 will be the same as the number of cutting or perforating knives or blades 18 on the periphery of the cylinder 1. As may be seen most clearly in FIG. 3, the wedge rod 24 is secured in an axially extending longitudinal groove 23 in the periphery of the adjusting spindle 16. The wedge rod 24 is provided with spaced adjustment wedges 26 along its length, as shown in FIG. 1. It will be seen that these adjustment wedges 26 do not extend out of groove 23. As the adjusting spindle 16 is moved axially by the push rod 21, the wedge rods 24 are also moved axially.

Figure 5:
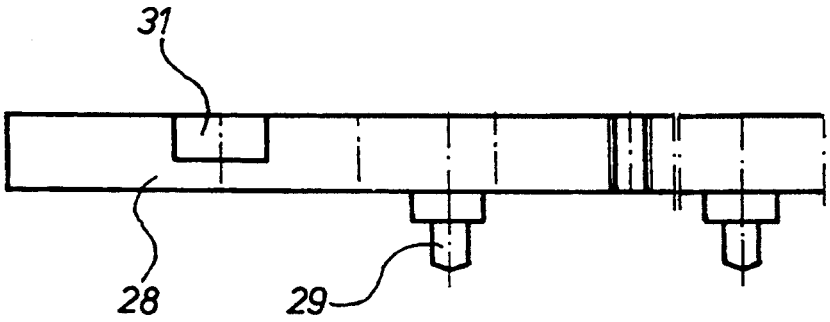
FIG. 5 is a side view of a wedge rod for accomplishing radial blade adjustment.

Referring again to FIGS. 1 and 3, there may be seen a wedge carrier rod 28. This wedge carrier rod 28 is supported for radial movement above its corresponding wedge rod 24 between radially outwardly extending flange support areas 27 on collar or flange portion 25 of the right side bushing 12 and a similar portion of the left side bushing. Since the right end bushing 12 and its associated left end bushing are fixed to outer sleeve 3, the wedge carrier rod 28 is also fixed and does not move axially. It does however move radially with respect to flange supports 27. A wedge carrier rod 28 in accordance with the present invention is shown by itself in FIG. 5. As may be seen most clearly in that drawing, the wedge carrier rod 28 has a plurality of radially inwardly extending counter wedge pieces 29 whose inner, wedge-shaped ends are received in the groove 23 in the axially slidable adjusting spindle 16 and which are shaped to cooperatively engage the adjusting wedges 26 on the wedge rod 24.

As the adjusting spindle 16 is caused to move axially by the push-rod 21, the wedge rod 24 and its integral adjusting wedges 26 also move axially. The counter wedge pieces 29 on the wedge carrier rod are in engagement with the adjusting wedges 26 and are moved radially. As may be seen most clearly in FIG. 1, each wedge carrier rod 28 has spaced, radially outwardly facing pocket holes 31 which act as seats for inner ends of compression springs 32. Outer ends of these compression springs 32 engage undersurface portions of cross pieces 34 of sleeve 3. Thus each wedge carrier rod 28 is able to move radially in a space 33 between the adjusting spindle 16 and the inner surface of sleeve 3. The wedge carrier rod 28 moves radially outwardly due to a wedging force exerted by the axially shiftable adjusting wedges against the counter wedge pieces. This radial outward movement is opposed by the compression springs 32.

Referring again to FIGS. 1 and 3, an axially extending groove 36 is machined or otherwise formed in the outer surface of sleeve 3 of adjustable cutting knife cylinder 1. This groove 36 does not extend completely through the sleeve 3 with the remaining inner web forming the cross piece 34. Each groove 36 receives one of the cutting or perforating blades or knives 18 with the number of grooves 36 thus being coordinated with the number of wedge rods 24 and wedge carrier rods 28. The compression springs 32 also have the task of absorbing the cutting forces applied by the cutting or perforating knives 18.

A plurality of stud bolts 37 are screwed at their radially inner ends into the wedge carrier rod 28. These stud bolts 37 are spaced longitudinally along the wedge carrier rod 28. Each stud bolt 37 is slidably received in a cooperating bore in the cross piece 34 so that the stud bolts 37 will be able to move radially in and out with respect to the fixed crosspiece 34. The barrel of each stud bolt 37 which passes through a bore in cross piece 34 is internally threaded. An upper or radially outer end of each of the plurality of longitudinally spaced stud bolts 37 acts as a support for an inner surface of a support bar 38. Suitable bolts pass through spaced apertures in support bar 38 and are received in the internally threaded bores in the barrels of stud bolts 37, as may be seen in FIG. 1. The length of the stud bolts 37 is selected so that there is provided a space between a radially inner surface of the support bar 38 and a base surface 39 of the groove 36; i.e. the top of the cross piece 34. This space insures that the radial movement of the cutting or perforating knife or blade 18, as will be discussed shortly, will not be hindered.

Figure 6:
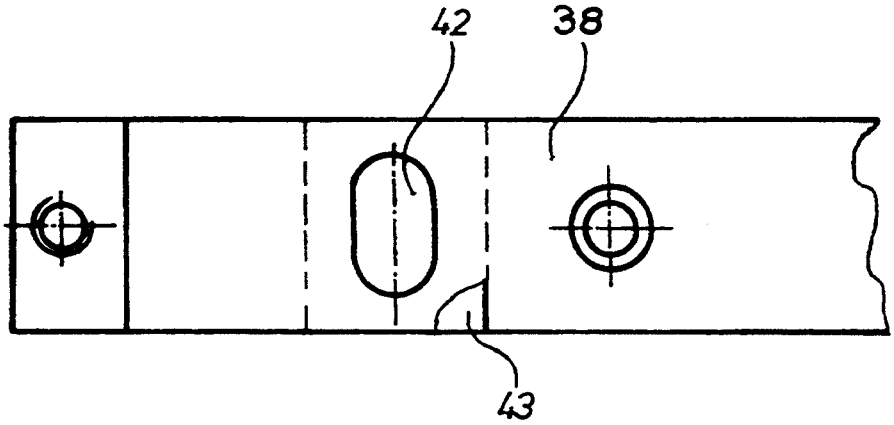
FIG. 6 is a top plan view of a support bar in accordance with the present invention.

As may be seen most clearly in FIGS. 1 and 3, a knife holder bar, generally at 41, is secured to the upper surface of the support bar 38. The knife holder bar 41 is capable of being shifted circumferentially with respect to the outer periphery of the sleeve 3, as will be discussed in more detail subsequently. As may be seen in FIG. 6, the support bar 38 is provided with spaced, transverse elongated apertures or holes 42 with the longitudinal axis of each of these holes 42 being at generally 90° to the longitudinal axis of the support bar 38. Each of these elongated holes 42 is formed in the support bar 38 in a reduced thickness portion or slot 43 in the bar 38.

Again returning to FIGS. 1 and 3, the knife holder bar 41 is secured to the support bar 38 by suitable screws 46 that have non-threaded intermediate shank portions which are sized to be slidably received in the elongated holes 42 in the support bar 38 and that have threaded ends which are received in tapped bores in the knife holder bar 41. A cup spring 44 is carried by the shank of each screw 46 and bears against the head of the screw 46 and the undersurface of the transverse slot 43 which is formed in the support bar 38. This structure allows the knife holder bar 41 to be secured to the support bar 38 while still allowing the knife holder bar 41 to move circumferentially with respect to the outer periphery of the sleeve 3 and transversely with respect to the longitudinal axis of the support bar 38.

Radial movement of the cutting or perforating blade or knife 18 and its associated knife holder bar 41 with respect to the periphery of the cylinder sleeve 3 is effected by causing the adjusting spindle 16 to move axially. This axial movement of spindle 16, as effected by push-rod 21 and as guided by key 17 in key slot 13 causes the wedge rod 24 and its adjusting wedges 26 to move axially with respect to the axially fixed wedge carrier rod 28 and its counter wedge pieces 29. However, shifting of the adjusting wedges to the left or right will effect a radial movement of the counter wedge pieces 29, the wedge carrier rod 28 in the space 33 and a radial movement of the support bar 38 which is connected to the wedge carrier rod by the spaced stud bolts 37. This radial movement of the support bar 38, in turn, results in a radial shifting or movement of the knife holder bar 41 and thus the knife 18. It will be understood that the height of the wedge rod 24 with respect to the groove 23 and the magnitude of the space 33 and the depth of the groove 36 will be sufficient to allow the support bar 38 to move radially inwardly to a point in which the edge of blade 18 is below the outer periphery of the cylinder 1.

As has been alluded to above, the cutting or perforating knife or blade 18 is also shiftable circumferentially with respect to the periphery of the cylinder 1 either in combination with, or independently of any radial movement of blade 18. This circumferential shifting of blade 18 is in a direction which is generally at 90° to the direction of movement of the axially shiftable adjustable spindle 16. Such circumferential shifting of cutting or perforating blade 18 is particularly beneficial when, in the case of the use of perforating knives 18, the perforating line is to be brought into exact alignment with a fold line, or when several cutting knives 18 are arranged on the circumference of the cutting cylinder for cutting "short" or "long" sheets.

Referring now primarily to FIGS. 2 and 3, a longitudinally extending slot 48 is milled or otherwise formed in the left vertical face of groove 36 which is located on the periphery of the thickened sleeve 3 that forms the body 2 of the cylinder 1. This longitudinally extending slot or groove 48 supports a shiftable adjustment rod 49 which is provided with a plurality of spaced circumferential adjusting wedges 51. The adjustment rod 49 is provided at its left end with a connecting piece 52. As may be seen in FIG. 2, this connecting piece 52 is supported in the left bearing journal 7 and is provided with an internal screw thread., This connecting piece 52 can receive a first end of a suitable machine element which can be moved back and forth. This machine element could be, for example a first end of a lever arm of a double-armed lever whose second end is provided with a roller that rides in a groove of a cam disc that is rotatable by a suitable motor. This allows the adjustment rod 49 to be axially shifted in groove 48 to an infinite number of positions.

As is shown most clearly in FIG. 2, a plurality of circumferential counter wedge pieces 53 are attached to the knife holder bar 41 and extend laterally out into the groove 36. These circumferential counter wedge pieces 53 have wedge surfaces that are engageable with cooperatively shaped wedge surfaces on the circumferential adjustment wedges 51. For ease of illustration, only one adjustment wedge 51 and counterwedge piece 53 have been shown in FIG. 2. A side 54 of the knife holder bar 41 opposite to the side to which the circumferential counter wedge pieces 53 are attached has a plurality of pocket bores 56. A compression spring 57 is placed in each one of these pocket bores 50 in knife holder bar 41 with a free end of each said compression spring 57 engaging a centering lug 58 that is formed on the right side wall 59 of the groove 36, as may be seen in FIG. 3.

When the knife holder bar 41 is to be shifted laterally or circumferentially to the right, as seen in FIG. 3, or to the bottom of the sheet, as seen in FIG. 2, the circumferential adjustment rod 49 is moved to the right or axially into the cylinder 1 from its position in the left end bearing journal 7. This causes the wedge surface 51 to bear against the counter wedge piece 53 and to slide the knife holder bar 41 across the upper surface of the support bar 38 against the force of the compression springs 57. This movement of the knife holder bar 41 is toward the right wall 59 of the groove 36 and is possible due to the movement of the screws 46 in the elongated slots or openings 42 in the support bar 38. If the circumferential adjustment rod 48 is moved to the left, as seen in FIG. 2, or axially out of the cylinder 1, the knife holder bar will shift to the left, as shown in FIG. 3, or away from the right groove wall 59 due to the force exerted by the compression springs 57. The knife holder bar 41 will thus move toward the left groove wall 47.

It will thus be seen that the adjustable cutting knife cylinder in accordance with the present invention is capable of effecting both a radial shifting of the knife or blade 18 by an axial movement of the adjustment spindle 16 and a concurrent or separate circumferential shifting of the knife or blade 18 by movement of the circumferential adjustment rod 49. Both the push rod 21, which effects the axial movement of the adjustment spindle 16, and the circumferential adjustment rod 49 can be shifted axially inwardly or outwardly in their respective bearing journals 8 and 7 by suitable means whose movement can be controlled automatically in response to various desired end results.

While an adjustable cutting knife cylinder assembly in accordance with the present invention has been set forth fully and completely hereinabove, it will be apparent to one of skill in the art that a number of changes in, for example, the overall size of the cylinder, the number of cutting or perforating knives or blades carried by the cylinder, the means for rotatably supporting the cylinder and the like could be made without departing from the true spirit and scope of the present invention which is accordingly to be limited only by the following claims.

What is claimed is:

1. An adjustable cutting knife cylinder which is usable with a cooperating counter cutting bar cylinder of a folder of a rotary printing press, said adjustable cutting knife cylinder comprising:

a cylinder body supported for rotation about a longitudinal axis of rotation;

at least a first cutting knife supported in a radially and circumferentially shiftable cutting knife holder at an outer peripheral portion of said cylinder body and extending generally parallel to said longitudinal axis of rotation;

a radially shiftable support bar supported in said cylinder body, said support bar supporting said cutting knife holder;

radial shifting means for radially shifting said support bar and said cutting knife holder supported by said support bar with respect to said outer peripheral portion of said cylinder body to shift said at least first cutting knife radially in said cylinder body; and circumferential shifting means for circumferentially shifting said cutting knife holder on said radially shiftable support bar in a direction generally 90° to said longitudinal axis of rotation to shift said at least first cutting knife circumferentially on said outer peripheral portion of said cylinder body.

2. An adjustable cutting knife cylinder usable with a cooperating counter cutting bar cylinder of a folder of a rotary printing press, said adjustable cutting knife cylinder comprising:

a cylinder body supported for rotation about a longitudinal axis of rotation;

at least a first cutting knife supported in a radially and circumferentially shiftable cutting knife holder at an outer peripheral portion of said cylinder body and extending generally parallel to said longitudinal axis of rotation;

a radially shiftable support bar supported in said cylinder body, said support bar supporting said cutting knife holder;

an adjustment spindle shiftably supported in said cylinder body for movement in the direction of said longitudinal axis of rotation of said cylinder body;

a radial wedge rod supported on said adjustment spindle and having radial adjusting wedges;

a radial wedge carrier rod having radial counter wedge pieces, said radial wedge carrier rod being connected to said radially shiftable support bar with said radial adjusting wedges contacting said radial counter wedge pieces to cause radial shifting of said support bar and said cutting knife holder and said cutting knife in response to longitudinal movement of said adjustment spindle;

an adjustment rod shiftably supported in said cylinder body for movement in the direction of said longitudinal axis of rotation of said cylinder body, said adjustment rod carrying circumferential wedge surfaces; and circumferential counter wedge pieces on said cutting knife holder, said circumferential counter wedge pieces and said circumferential wedge surfaces being in sliding contact to cause circumferential shifting of said cutting knife holder and said cutting knife on said radially shiftable support bar in response to longitudinal movement of said adjustment rod.

3. The adjustable cutting knife cylinder of claim 2 wherein said radial wedge carrier rod is supported for radial movement toward and away from said radial wedge rod.

4. The adjustable cutting knife cylinder of claim 2 wherein said adjustment rod is supported for longitudinal movement in a first side wall of a channel formed in said outer peripheral portions of said cylinder body.

5. The adjustable cutting knife cylinder of claim 4 further including a plurality of longitudinally spaced compression springs having first ends in engagement with said cutting knife holder and having second ends in engagement with a second side wall of said channel, said compression springs biasing said circumferential wedge surfaces and said circumferential counter wedge pieces into said sliding contact.

* * * * *